United States Patent [19]

Beall

[11] 4,105,189

[45] Aug. 8, 1978

[54] LINE DIVERTING TOOL

[76] Inventor: John Horace Beall, 3 Links Rd., Gorleston-on-Sea, Great Yarmouth, Norfolk, England

[21] Appl. No.: 716,079

[22] Filed: Aug. 20, 1976

[30] Foreign Application Priority Data

Aug. 23, 1975 [GB] United Kingdom ..... 35073/75

[51] Int. Cl.[2] ..... B66C 23/60

[52] U.S. Cl. ..... 254/139; 166/75 R

[58] Field of Search ..... 254/139, 188, 139.1, 254/190 R, 134.3 CL, 134.3 R, 144; 166/75, 97

[56] References Cited

U.S. PATENT DOCUMENTS

| | | | |
|---|---|---|---|
| 1,878,859 | 9/1932 | Knabershue | 254/134.3 R |
| 3,071,190 | 1/1963 | Ehlert | 166/75 |
| 3,226,088 | 12/1965 | Habighorst | 254/139.1 |
| 3,429,374 | 2/1969 | Pridy | 166/75 |
| 3,968,952 | 7/1976 | Newell | 254/139.1 |

*Primary Examiner*—Trygve M. Blix
*Assistant Examiner*—Kenneth Noland
*Attorney, Agent, or Firm*—Wellington M. Manning, Jr.; Luke J. Wilburn, Jr.

[57] ABSTRACT

A line diverter unit for use with a sand line in a drill pipe comprising a body threaded for attachment to a drill pipe elevator and a pair of pulleys arranged to guide a sand line into a bore through the body and thence into the drill pipe, one of the pulleys being mounted on a collapsible linkage so that, in use, the pulley is located away from the drill pipe axis and clear of fouling engagement with any mechanism associated with the drill pipe and its support.

5 Claims, 3 Drawing Figures

LINE DIVERTING TOOL

This invention is concerned with a line diverter unit for use with a sand line in a drill pipe, the sand line being particularly used for survey purposes in the well.

When drilling an oil or gas well it is necessary from time to time to survey the well drilled so far and check for deviation from the vertical. The normal procedure is to run into the drill pipe in the well the survey equipment on a sand line, i.e. a relatively thin wire rope. However, to prevent binding of the drill pipe in the well bore it is necessary to keep the drill pipe moving while the survey is being conducted. This movement of the drill pipe is normally and desirably a longitudinally reciprocating movement, but this tends to result in chafing of the sand line against the open end of the drill pipe and against the blocks supporting the drill pipe, and the danger of kinking of the sand line.

It is an object of the present invention to obviate or mitigate these difficulties.

The present invention is a line diverter unit adapted to be located on a drill pipe and comprising a body having a bore passing therethrough from a top end to a bottom end, a first pulley located at the top end to guide a line into said bore, a second pulley for passing said line to said first pulley, and a linkage extending from the body and mounting said second pulley, the linkage in use supporting said pulley away from the axis of said bore whereby the sand line extends upwardly from the second pulley clear of the drill line supporting mechanisms.

Preferably a shut off valve is included in the body of said unit.

Said linkage may include a first link secured to said body and extending to the side thereof, a second link pivotally mounted at one end to the first link and mounting at its other end the second pulley, and a spacer fixed to said second link, whereby when the unit is in use the second pulley is spaced from the axis of the bore by the spacer.

Figure 1:
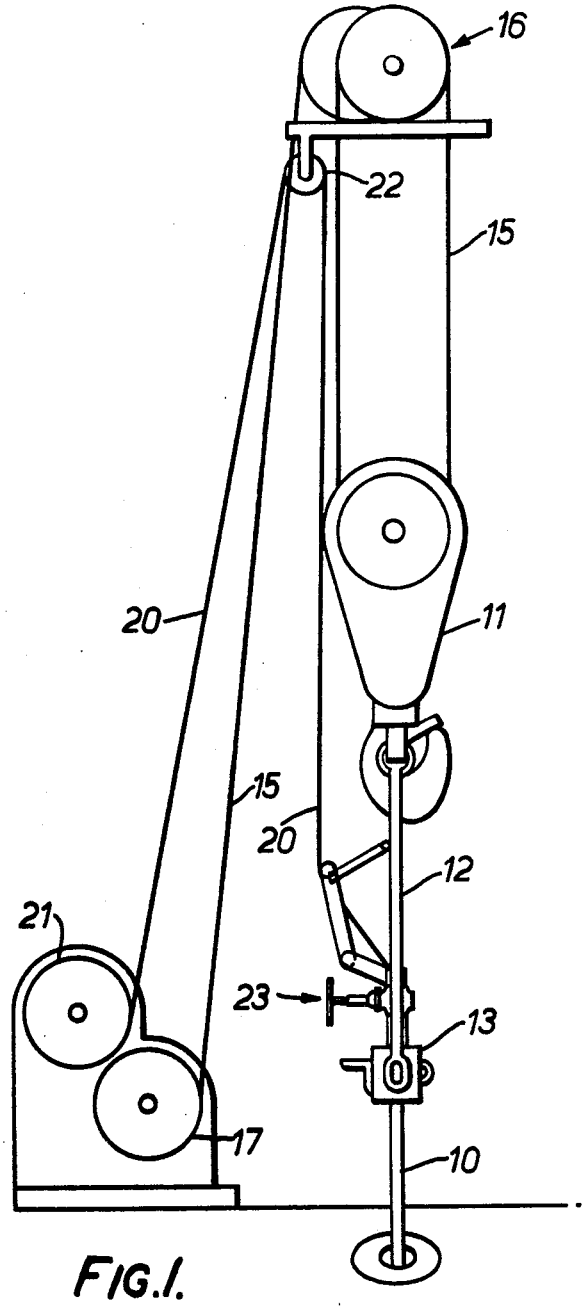
Figure 2:
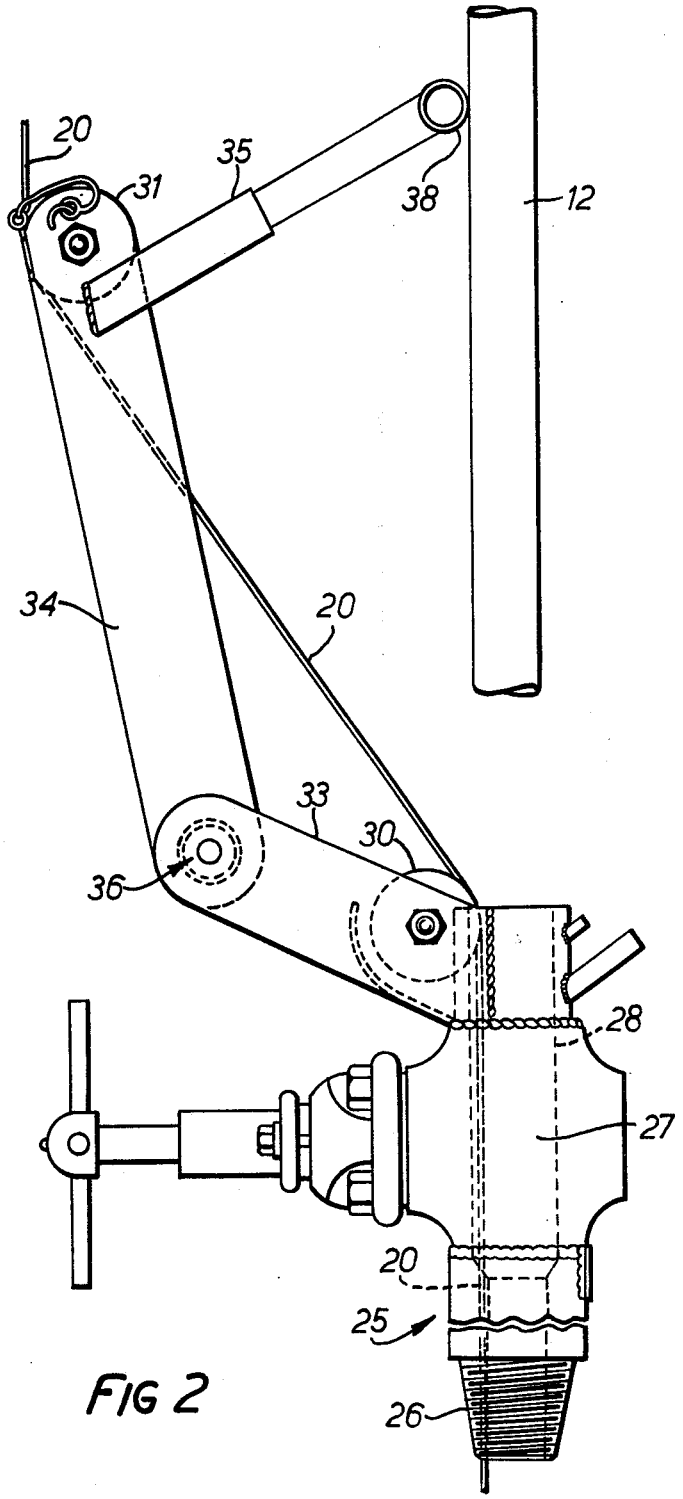
Figure 3:
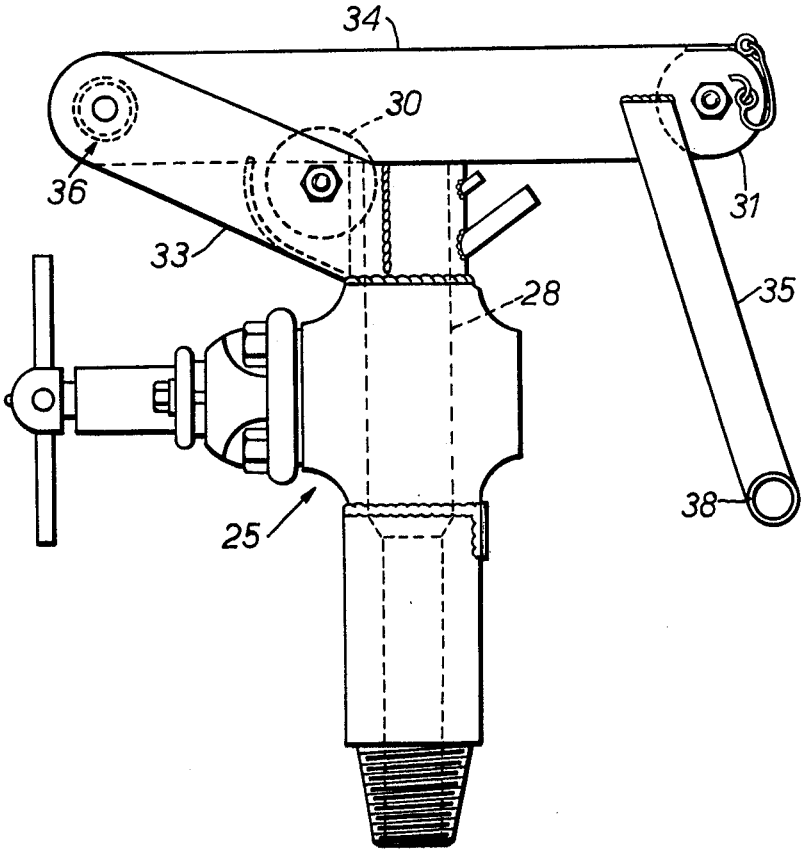

An embodiment of the present invention will now be described by way of example, with reference to the accompanying drawings, in which:

FIG. 1 is a diagrammatic view of well head equipment showing the location of the diverter unit of the present invention;

FIG. 2 is a side elevation of the diverter unit of FIG. 1 to a larger scale; and FIG. 3 is a side elevation of the diverter unit of FIG. 2 out of use. de Referring now to FIG. 1, during a well survey the well pipe 10 is supported from a travelling block 11 by means of elevator links 12, of which only one is visible in FIG. 1, secured to a drill pipe elevator 13 which is attached to the well pipe 10. the travelling block 11 is supported by a drill line 15 which runs over pulleys 16 supported in the well derrick (not illustrated) to a drill line drum 17. In this way forward and reverse movements of the drum 17 result in longitudinal reciprocation of the well pipe 10 in the well bore.

A sand line 20 runs from a sand line drum 21 over a pulley 22 supported by the derrick and down into the well pipe 10, its entry into the pipe 10 being through a line diverter unit generally indicated at 23. It is understood that the sand line 20 supports a survey instrument at the required depth in the well, the depth being controlled by the drum 21.

Referring now to FIG. 2, the line diverter unit 23 includes a body 25 threaded at its lower end 26 for attachment to the drill pipe elevator 13 shown in FIG. 1. At the centre of the body 25 is provided a manually operable shut off valve 27 of conventional design for closing a bore 28 passing vertically through the body 25 of the unit 23. The sand line 20 passes up through the bore 28, over a pulley 30 at the top of the body 25 and thence out to a second pulley 31, the sand line thus being kept clear of the top edge of the bore 25 and, as seen in FIG. 1, of the travelling block 11 and of the other drill pipe supporting mechanisms. The bearings of the pulleys 30 and 31 are, of course, double sealed to allow use in the most arduous conditions.

The second pulley 31 is supported away from the axis of the bore 28 by a linkage comprising first and second links 33 and 34, each in the form of a pair of parallel plates, and a spacer 35. The first link 33 is fixed to the top of the body 25 and extends to the side of the body 25. At its outer end the link 33 is pivotally attached to one end of the link 34 as by a pin and bearing assembly 36. At its other end the link 34 carries the pulley 31 and mounts the spacer 35 which extends back towards the bore axis. The spacer 35 is welded at its end to the link 34 and, if desired, a rigid support link may interconnect the link and the spacer intermedite their ends. The spacer 35 comprises two diverging arms interconnected at the ends remote from the link 34 by a tube 38 which bears against the elevator links 12. To allow for flexibility in positioning the linkage and the sand line 20 relative to the links 15 and the drill pipe suporting mechanisms, the arms of the spacer 35 may be length adjustable, e.g. telescopic.

It should of course be appreciated that the linkage is maintained in the position of FIG. 2 only by the balance of the force transmitted to the pulley 31 by the sand line 20 and the reaction of the link 12 on the spacer tube 38. When out of use or for storage the linkage folds about the pin and bearing assembly 36 to assume the compact configuration of FIG. 3.

Thus the line diverter unit 23 of the present invention provides a simple means of keeping a sand line clear of the mouth of the well pipe and of the supporting mechanisms therefor to avoid chafing and kinking whilst permitting longitudinal reciprocation of the well pipe and isolating the survey instrument at the end of the sand line from that reciprocation.

I claim:

1. In combination with a drill pipe and means for supporting and axially reciprocating the drill pipe, a line diverter unit comprising a body having a bore passing therethrough from a top end to a bottom end thereof, said body including means for attaching the body to said means for supporting and axially reciprocating the drill pipe, a shut off valve in said body, a first pulley located at the top end of said body to guide a line into said bore, a second pulley for passing said line to said first pulley, and a linkage extending from said body and mounting said second pulley thereon, the linkage during reciprocation of the drill pipe and supporting means positioning said second pulley away from the axis of said bore whereby a sand line extending upwardly from said second pulley remains clear of said drill pipe supporting means.

2. A unit as claimed in claim 1, in which said linkage includes a first link secured to the body and extending to the side thereof, a second link pivotally mounted at one end to the first link and mounting at its other end the second pulley, and a spacer fixed to said second link, whereby when the unit is in use the second pulley is spaced from the axis of the bore by the spacer.

3. A unit as claimed in claim 2, in which a rigid support is provided between the second link and the spacer.

4. A unit as claimed in claim 2, in which said spacer is length adjustable.

5. A line diverter unit comprising:

(a) a body having a bore passing therethrough from a top end to a bottom end, said body including means for attachment to a reciprocable drill pipe unit outside a hole being drilled;

(b) a first linkage rigidly secured to said body and extending outwardly therefrom, said first linkage having a pulley received thereon at a location adjacent said body bore at said top end thereof;

(c) further linkage pivotally secured to said first linkage at one end away from said body, said further linkage having a second pulley received thereon, said further linkage also having spacer means rigidly secured thereto and extending outwardly therefrom, whereby during operation with a reciprocable drill pipe unit, an element passing over said first and second pulleys will be held away from said reciprocable apparatus by said spacer and linkage while being permitted to pass through said body into said drill pipe.

* * * * *